US008061641B2

(12) United States Patent
Helm et al.

(10) Patent No.: US 8,061,641 B2
(45) Date of Patent: Nov. 22, 2011

(54) ROLLER MILL FOR GRINDING PARTICULATE MATERIAL

(75) Inventors: Alexander Helm, Allerod (DK); Rasmus Thranberg Nissen, Gentofte (DK)

(73) Assignee: FLSmidth A/S (DK)

( * ) Notice: Subject to any disclaimer, the term of this patent is extended or adjusted under 35 U.S.C. 154(b) by 63 days.

(21) Appl. No.: 12/667,104

(22) PCT Filed: Jul. 4, 2007

(86) PCT No.: PCT/EP2007/056771

§ 371 (c)(1), (2), (4) Date: Dec. 29, 2009

(87) PCT Pub. No.: WO2009/003528

PCT Pub. Date: Jan. 8, 2009

(65) Prior Publication Data

US 2010/0176232 A1 Jul. 15, 2010

(51) Int. Cl.
*B02C 15/00* (2006.01)

(52) U.S. Cl. ..... 241/117

(58) Field of Classification Search ..... 241/117–121
See application file for complete search history.

(56) References Cited

U.S. PATENT DOCUMENTS 4,235,385 A * 11/1980 Brundiek ..... 241/110
4,717,082 A * 1/1988 Guido et al. ..... 241/121
5,039,021 A * 8/1991 Eisinger ..... 241/121

* cited by examiner

*Primary Examiner* — Faye Francis
(74) *Attorney, Agent, or Firm* — Armstrong Teasdale LLP

(57) ABSTRACT

A roller mill (1) for grinding particulate material such as cement raw materials, cement clinker and similar materials has a substantially horizontal grinding table (3) and a set of rollers revolving about a vertical shaft (5). The set of rollers includes a number of rollers (4) rotating about respective roller shafts (6) which are connected to the vertical shaft (5) via a hinged connection (7) which has a bearing shell (14) and a bearing journal (15) resting therein. The hinged connection (7) allows a free arcuate movement of the roller (4) in an upward and downward direction in a plane including the centerline (12) of the roller shaft. The set of rollers (4) is configured for interactive operation with the grinding table (3), and the bearing shell (14) of the hinged connection (7) has a diameter which exceeds that of the bearing journal (15) resting therein by a factor of at least 1 percent.

5 Claims, 2 Drawing Sheets

ROLLER MILL FOR GRINDING PARTICULATE MATERIAL

BACKGROUND OF THE INVENTION

1. Field of the Invention

The present invention relates to a roller mill for grinding particulate material such as cement raw materials, cement clinker and similar materials, said roller mill comprising a substantially horizontal grinding table and a set of rollers rotatable about a vertical shaft, said set of rollers comprising a number of rollers rotating about separate roller shafts which are connected to the vertical shaft via a hinged connection which comprises a bearing shell and a bearing journal resting therein, and allowing a free circular movement of the roller in upward and downward direction in a plane comprising the centreline of the roller shaft, said set of rollers being configured for interactive operation with the grinding table.

2. Description of Related Art

Roller mills of the aforementioned kind are well known. In the known roller mills the hinged connection which connects the roller shaft with the vertical shaft typically consists of a traditional slide bearing which may be lubricated using a suitable lubricant. The function of the hinged connection is to ensure that, independently of one another, the rollers will be able to follow the height variations occurring in the layer of material deposited on the grinding table during the operation of the mill. In terms of direction and magnitude, the force to be absorbed by the hinged connection is mainly constant relative to the bearing journal, the angular motion of which is produced by the variations in the thickness of the material layer, typically ranging within an interval of ±0.5 to 5 degrees. The frequency of the angular motion of the bearing journal will typically be within the interval of 0.5 to 1 Hz. When this known roller mill is used for grinding particulate material such as cement raw materials, cement clinker and similar materials, the hinged connection will be subjected to a relatively high pressure which subject to friction between the parts of the hinged connection will give rise to a detrimental generation of heat which cannot readily be reduced by means of a lubricant since the unilateral constant application of pressure and the very small angular motions back and forth of the bearing journal may preclude the lubricant from being drawn into the zone of loading. Of other commercially available bearing types may be mentioned a hydrodynamic slide bearing which cannot be used since the bearing journal is not continuously turned and hence does not build-up a hydrodynamic lubricating film, a hydrostatic radial bearing which from a technical viewpoint is an ideal bearing solution ensuring a full level of contact whether in static operation or subject to rotation, but being too complicated, sensitive and costly, and a rolling bearing which is not suitable since the small angular motions will prevent the journals from drawing lubricant into the zone of loading. So, the conclusion to be drawn is that none of the traditional, commercial bearing types have the characteristics required to handle the load situation described without entailing significant disadvantages.

BRIEF SUMMARY OF THE INVENTION

It is the object of the present invention to provide a roller mill by means of which the aforementioned disadvantages are eliminated or significantly reduced.

This is obtained by means of a roller mill of the kind mentioned in the introduction and in which the bearing shell of the hinged connection has a diameter which exceeds that of the bearing journal resting therein by a factor of at least 1 percent.

It is hereby obtained that the friction and hence the heat generation and the wear rate between the bearing journal and the bearing shell of the hinged connection is much smaller than for the bearing types used up to now. This is ascribable to the fact that the bearing journal in connection with minor angular motions primarily rolls in the bearing shell. Furthermore, such a hinged connection may be operative without lubrication and without sealing protection against the material which is being ground in the roller mill.

In principle, the diameter ratio between the bearing journal and bearing shell must be selected exactly so that that the small high-frequency angular motions which correspond to the general variation in the material layer on the grinding table are absorbed by the bearing in connection with its rolling movements without causing an excessively high surface pressure which increases in step with the increase in the diameter ratio. According to the invention it is therefore preferred that the bearing shell has a diameter which exceeds that of the bearing journal resting therein by a factor which is between 1 and 25 percent, preferably between 5 and 20 percent.

The same material, e.g. steel, can be used for manufacturing the bearing journal and the bearing shell. From the viewpoint of strength characteristics and from an economic perspective this is a distinct advantage, making it possible also to achieve the most favourable friction conditions in the hinged connection according to the invention.

BRIEF DESCRIPTION OF THE SEVERAL VIEWS OF THE DRAWINGS

The invention will now be described in further details with reference to the drawing, being diagrammatical, and where.

DETAILED DESCRIPTION OF THE INVENTION

Figure 1:
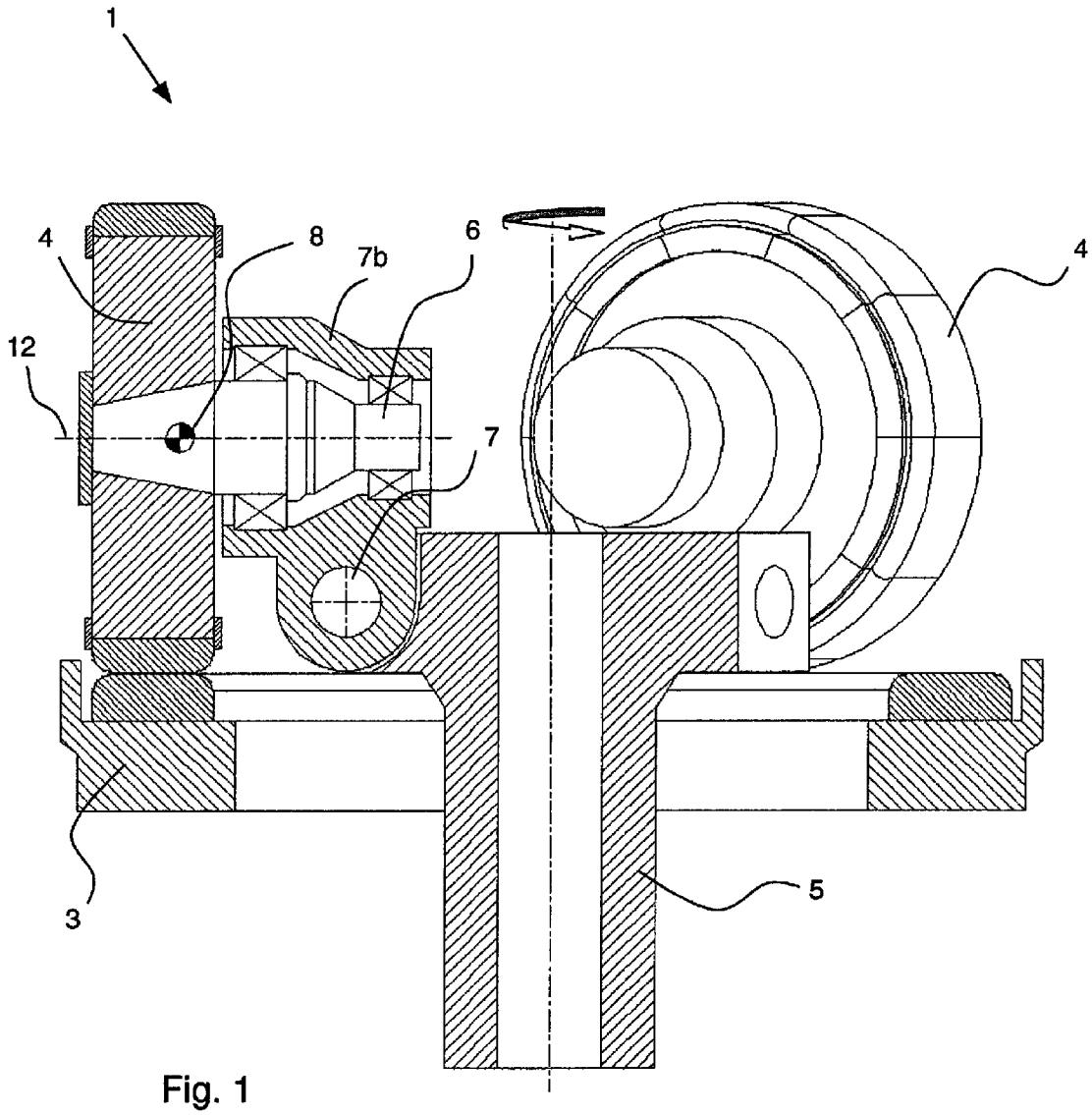
FIG. 1 shows a schematic diagram of a roller mill according to the invention.

In the figure is seen a sectional view of a roller mill 1 which comprises a horizontal grinding table 3 and a set of rollers 4 operating interactively therewith, said rollers being connected to and rotating about a vertical shaft 5. The rollers 4 rotate about separate horizontal roller shafts 6 which are connected to the vertical shaft 5 via a hinged connection 7 which allows the roller 4 while turning about the shaft to move freely in upward and downward direction in a plane comprising the centreline 12 of the roller shaft. The plane in which the roller moves does not necessarily include the centreline of the vertical shaft. To obtain a minor sliding or shearing effect in the grinding zone the roller is sometimes or quite often slightly angled, meaning that its centreline does not always pass through the centreline of the vertical shaft.

The centre of rotation of the hinged connection 7 may be placed at the same horizontal plane as the centreline 12 of the roller shaft. In the shown embodiment the centre of rotation of the hinged connection 7, viewed in a vertical plane, is, however, located under the horizontal plane which comprises the centre of mass 8 for the roller 4, the roller shaft 6 and the hinge part 7*b* connected thereto, shown in the drawing by a dot-and-dash line which for reasons of simplicity coincides with the centreline 12 of the roller shaft. This will cause the centrifugal force which during the operation of the mill acts upon the roller 4, the roller shaft 6 and the hinge part 7*b* connected thereto, to produce a turning moment about the hinge 7 and hence a downwardly directed force which contributes towards generating the grinding pressure of the roller 4 against the grinding table 3.

Figure 2:
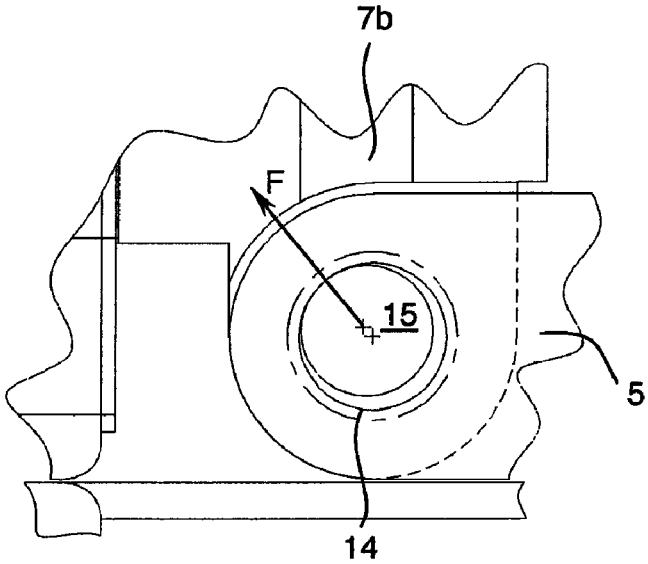
FIG. 2 shows details of the hinged connection according to the invention.

As is apparent from FIG. 2, the hinged connection 7 comprises a bearing shell 14 and a bearing journal 15 resting therein. According to the invention the bearing shell 14 has a diameter which exceeds that of the bearing journal 15 by at least one percent, causing the friction and hence the heat generation and the wear rate between the bearing journal 15 and the bearing shell 14 of the hinged connection to be much smaller than for bearing types previously used given that the bearing journal 15 primarily rolls in the bearing shell 14 in connection with small angular motions.

In order to ensure that the small high-frequency angular motions which correspond to the general variation in the material layer on the grinding table are absorbed in optimum manner by the bearing in connection with rolling movements without causing the surface pressure to reach an excessively high level, the bearing shell 14 must have a diameter which exceeds that of the bearing journal 15 by a factor between 1 and 25 percent, preferably between 5 and 20 percent.

Figure 3:
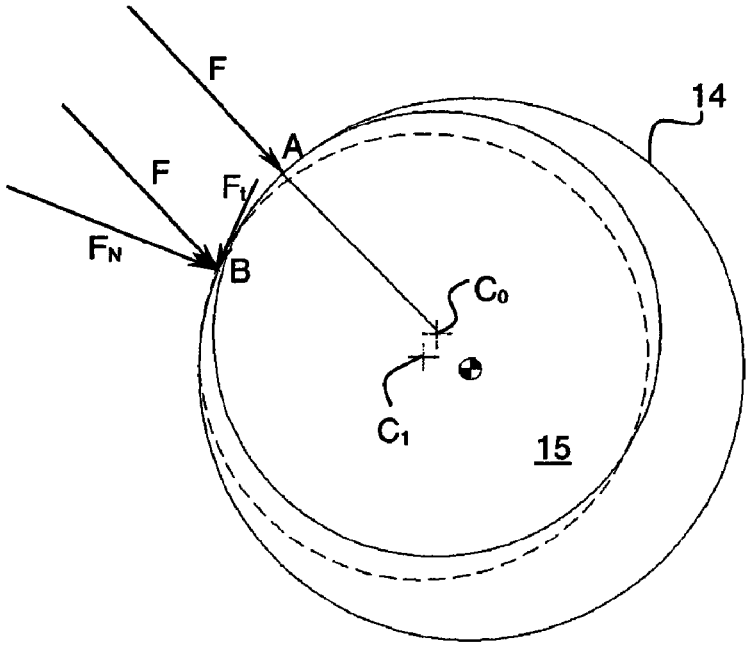
FIG. 3 shows details of the function of the hinged connection during operation.

As is apparent from FIG. 3, the contact point between the bearing shell 14 and the bearing journal 15 will be transferred from point A to point B when the centre $C_o$ of the bearing journal 15 when rolling in clockwise direction is transferred to point $C_1$ which will be the case when the roller 4 is rolling over an elevated point of the material layer on the grinding table 3.

In the neutral position given at A and $C_o$ the reaction F is a normal vector to the tangent plane in point A. When the bearing journal 15 is moved to $C_1$, the reaction F will be made up of two contributions, viz. a normal force $F_N$ and a friction force $F_t$. The maximum value of the friction force will be $F_t=F_N\times\mu_s$, where $\mu_s$ is the static friction coefficient which for "steel against steel" will assume an approximate value of 0.3. If the $F_t$ value is exceeded, the bearing journal 15 will slide back towards the point A, assuming a new neutral position for the rolling movement which is consistent with the elevated material layer on the grinding table 3.

The invention claimed is:

1. A roller mill for grinding particulate material, said roller mill-comprising, a substantially horizontal grinding table and a set of rollers revolving about a vertical shaft;

said set of rollers comprising a number of rollers rotating about respective roller shafts which are connected to the vertical shaft via a hinged connection which comprises a bearing shell and a bearing journal resting therein, said hinged connection allowing a free arcuate movement of the roller in an upward and downward direction in a plane including the centreline of the roller shaft; and said set of rollers being configured for interactive operation with the grinding table;

wherein the bearing shell of the hinged connection has a diameter which exceeds that of the bearing journal resting therein by a factor of at least 1 percent.

2. A roller mill according to claim 1, wherein the bearing shell has a diameter which exceeds that of the bearing journal resting therein by a factor which is between 1 and 25 percent.

3. A roller mill according to claim 1, wherein the bearing shell has a diameter which exceeds that of the bearing journal resting therein by a factor which is between 5 and 20 percent.

4. A roller mill according to claim 1, wherein the bearing shell and the bearing journal are manufactured of the same material.

5. A roller mill according to claim 4, wherein the bearing shell and the bearing journal are manufactured from steel.

* * * * *